United States Patent [19]

Dorsey-Zinn et al.

[11] Patent Number: 4,811,951

[45] Date of Patent: Mar. 14, 1989

[54] PUZZLE INCLUDING PIECES FORMED FROM A CRAYON MATERIAL

[75] Inventors: Denise Dorsey-Zinn; Sue M. Meiser; Michael F. Cassidy, all of Lafayette, Ind.

[73] Assignee: Random House, Inc., New York, N.Y.

[21] Appl. No.: 193,012

[22] Filed: May 12, 1988

[51] Int. Cl.[4] ..... A63F 9/10

[52] U.S. Cl. ..... 273/157 R; 434/84

[58] Field of Search ..... 273/157 R, 156; 434/84

[56] References Cited

FOREIGN PATENT DOCUMENTS 3806 9/1878 United Kingdom ..... 273/157 R 2182253 5/1987 United Kingdom ..... 273/157 R

*Primary Examiner*—Anton O. Oechsle

*Attorney, Agent, or Firm*—Blum Kaplan

[57] ABSTRACT

A puzzle having two sets of puzzle pieces with enhanced play value. The puzzle includes a frame having a recessed portion formed therein adapted to releaseably, interchangeably hold the two sets of puzzle pieces. The first set of puzzle pieces are formed from a crayon material and are adapted to be selectively arranged in a predetermined pattern in the recessed portion to complete the puzzle. The second set of puzzle pieces are adapted to be selectively arranged in the predetermined pattern in the recessed portion after the first plurality of puzzle pieces are removed to complete the puzzle. As the crayons forming the first set of puzzle pieces are used to color and decrease in size, the second set of puzzle pieces can be used to complete the puzzle.

11 Claims, 2 Drawing Sheets

FIG. 3
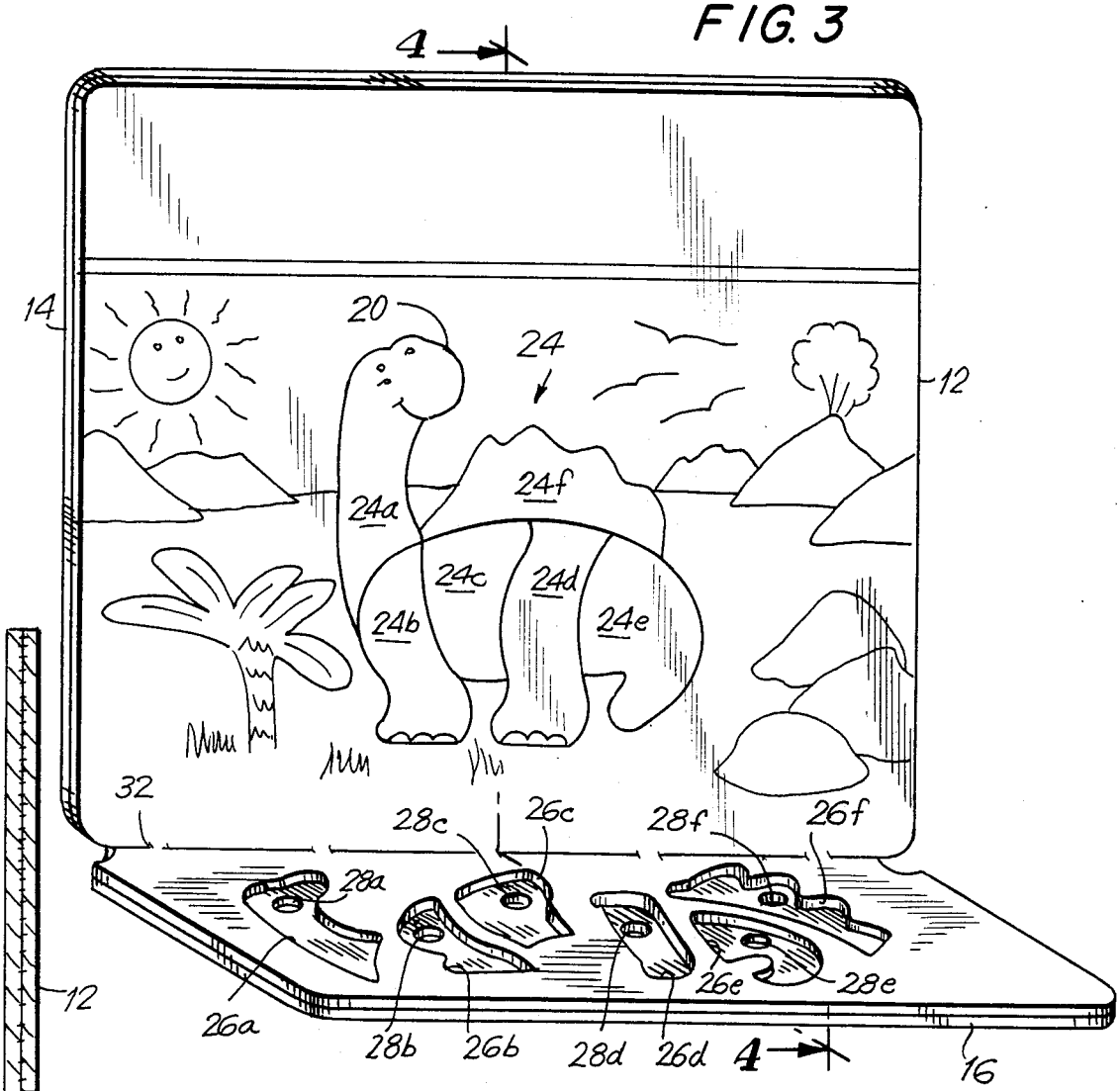
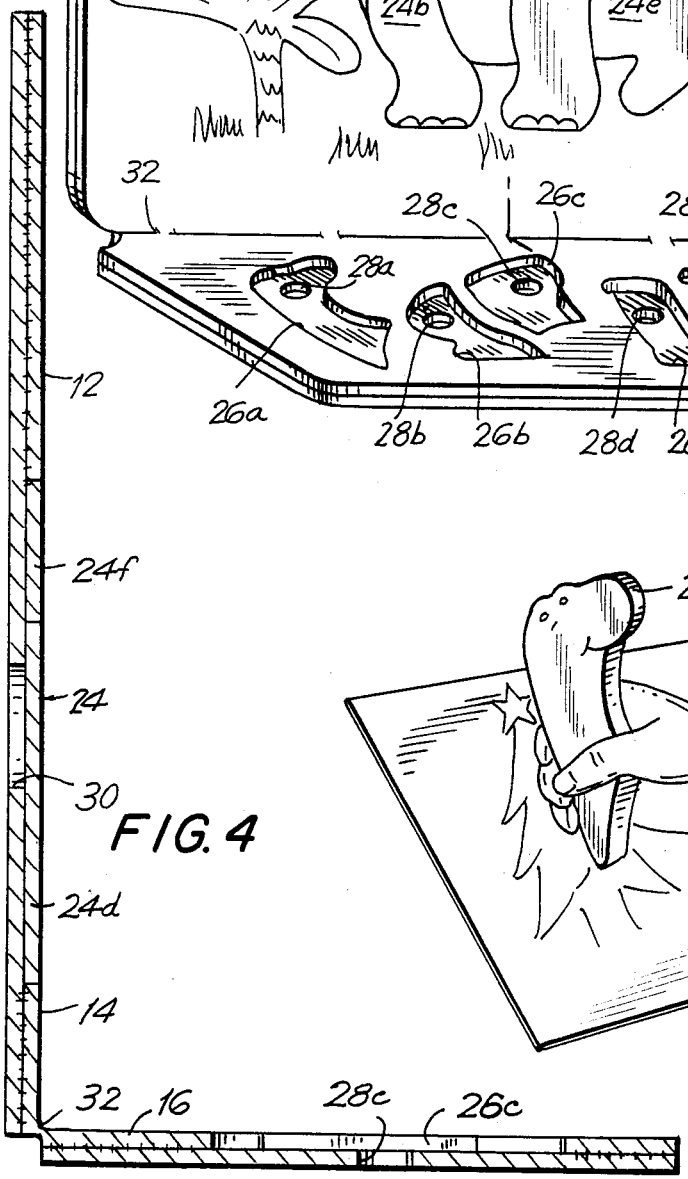
FIG. 4
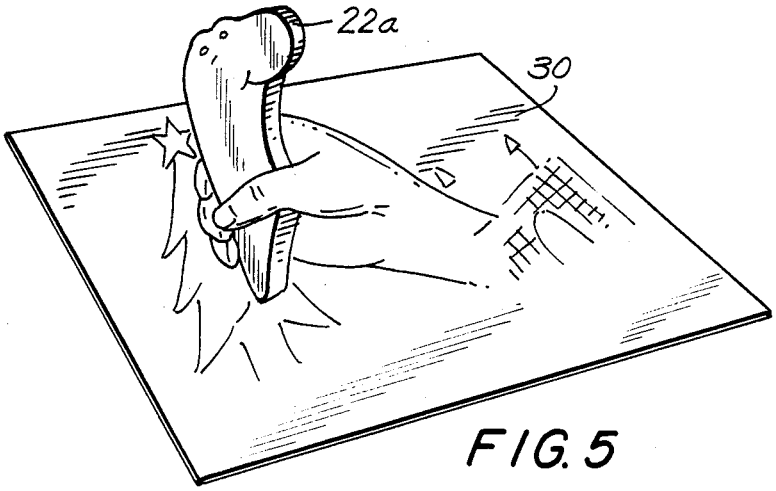
FIG. 5

PUZZLE INCLUDING PIECES FORMED FROM A CRAYON MATERIAL

BACKGROUND OF THE INVENTION

The present invention is directed generally to a puzzle for use by children and, in particular, to a puzzle with two sets of puzzle pieces, one set being formed from a crayon material, with enhanced play value.

Conventional puzzles either include a frame in which die-cut puzzle pieces are inserted to complete the puzzle, or separate die-cut pieces which are joined together to form the puzzle on a flat surface. While such puzzles are interesting during the first or perhaps the second completion of the puzzle, the initial play value thereof substantially decreases once the puzzle has been completed one or two times.

In an effort to enhance the play value of puzzles, several games have been developed for playing by two or more people such as those disclosed in U.S. Pat. No. 4,205,850 issued on June 3, 1980 for a partner puzzle game and U.S. Pat. No. 3,558,136 issued on Jan. 26, 1971 for a double jig-saw puzzle game. However, such puzzles are not appropriate for use by one person.

Puzzles offer the users thereof, especially children, a chance to increase their skills of recognition, spatial orientation and ordering, and related cognitive skills. Thus, it is important for young children to be interested in and play with puzzles, and therefore it is desirable to provide a puzzle with enhanced play value which is suitable for use by children. The present invention provides such a configuration.

SUMMARY OF THE INVENTION

Generally speaking, in accordance with the present invention, a puzzle having two sets of puzzle pieces is provided. The puzzle includes a frame having a recesseed portion formed therein and adapted to releaseably, interchangeably hold the two sets of puzzle pieces. The first set of puzzle pieces is formed from a crayon material and can be used to color pictures, as desired. The first set of puzzle pieces is adapted to be selectively arranged in a predetermined pattern in the recessed portion of the frame to complete the puzzle.

As the first set of puzzle pieces is utilized as crayons to color by a child, the puzzle pieces will decrease in size thereby no longer conforming to the shape of the recessed portion in the frame. Accordingly, a second set of puzzle pieces is provided which are adapted to be selectively arranged in the predetermined pattern in the recessed portion of the frame after the first plurality of puzzle pieces are removed therefrom to complete the puzzle. The second set of puzzle pieces is preferably formed from a rigid paper material to provide a permanent set of puzzle pieces to be used in the puzzle frame.

Accordingly, it is an object of the present invention to provide an improved puzzle having two sets of puzzle pieces.

Another object of the present invention is to provide a puzzle with two sets of puzzle pieces which can be interchangeably used to complete the puzzle, where one set of puzzle pieces is formed from a crayon material which can be used to color by a child.

A further object of the present invention is to provide an improved puzzle with enhanced play value which will keep the interest of a child in playing with, completing the puzzle and coloring with the puzzle pieces.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a front perspective view of the puzzle of the present invention, similar to FIG. 1, but showing the first set of puzzle pieces removed and the second set of puzzle pieces completing the puzzle;

FIG. 4 is an enlarged sectional view taken along line 4—4 of FIG. 3; and

FIG. 5 is a perspective view of a puzzle piece from the set of puzzle pieces being used as a crayon to color a picture.

DETAILED DESCRIPTION OF THE PREFERRED EMBODIMENT

Figure 2:
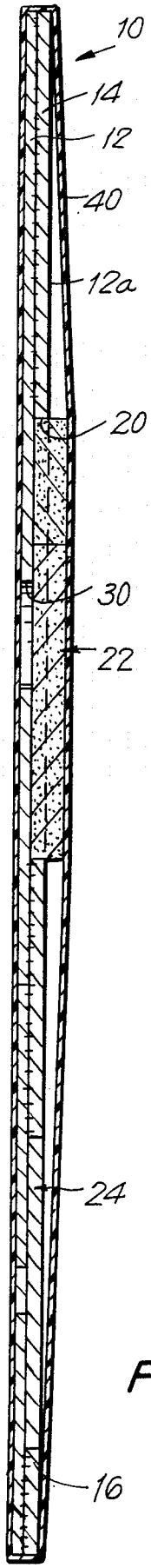
FIG. 2 is an enlarged sectional view taken along line 2—2 of FIG. 1.
Figure 1:
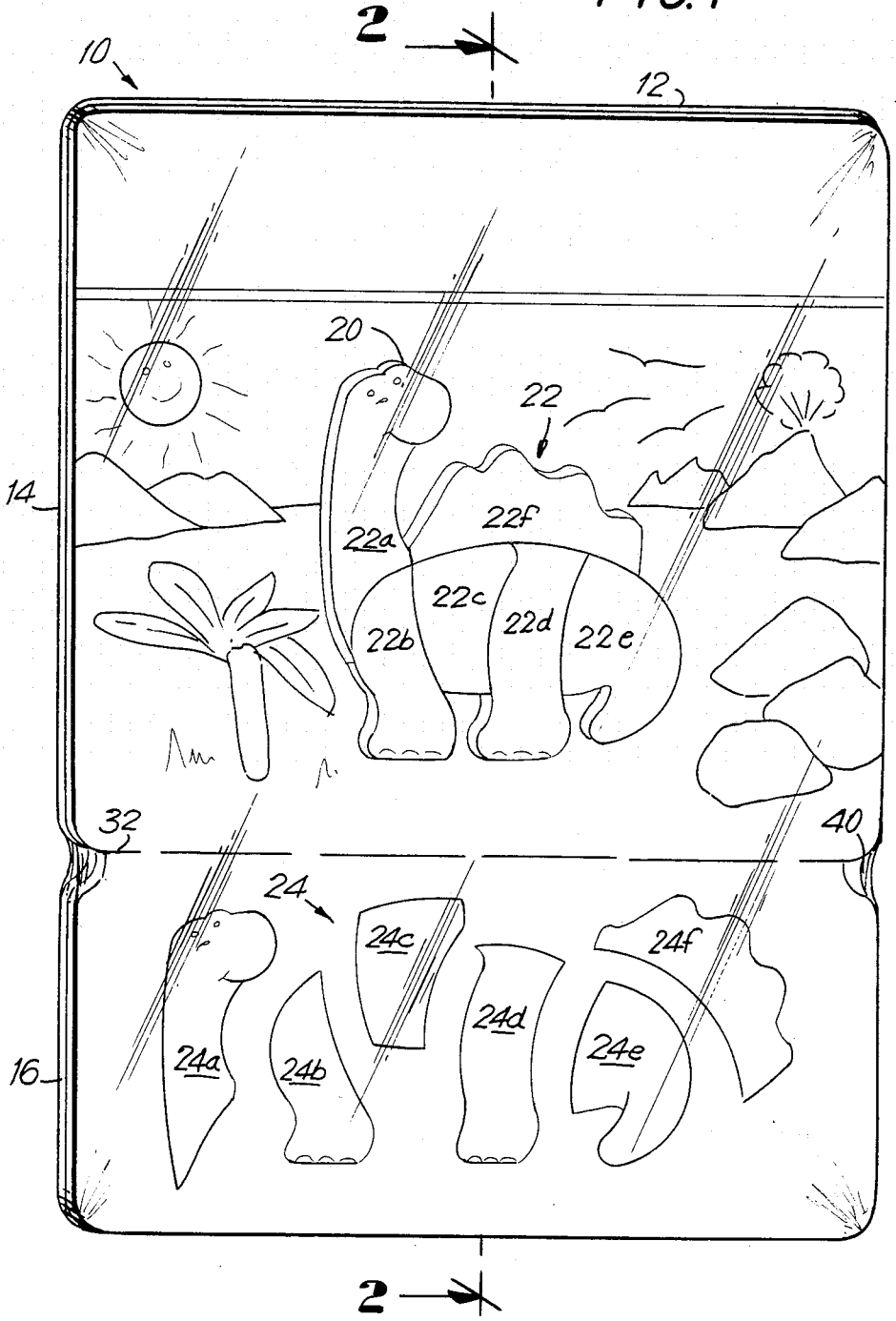
FIG. 1 is a front elevational view of a puzzle constructed in accordance with a preferred embodiment of the present invention.

Reference is first made to FIGS. 1 and 2 which depict a puzzle, generally indicated at 10, and constructed in accordance with a preferred embodiment of the present invention. Puzzle 10 includes a frame 12, preferably formed from a rigid paper or cardboard material, having a first section 14 and a second section 16.

First section 14 of frame 12 includes a recessed portion 20 in a predetermined shape. As depicted in the drawing figures in this application, recessed portion 20 is in the shape of a dinosaur. A first plurality of puzzle pieces, generally indicated at 22 and including puzzle pieces 22*a* through 22*f* are releaseably held in recessed portion 20 in frame 12 in a predetermined pattern to form the dinosaur. Each of puzzle pieces 20*a* through 20*f* in the first plurality of puzzle pieces 22 are formed from a crayon material so that when they are removed from recessed portion 20 by a child, the pieces can be used to color a drawing as, for example, depicted in FIG. 5.

It is noted that first plurality of puzzle pieces 22 can be used both to color drawings such as drawing 30 in FIG. 5 or to complete the puzzle as depicted in FIG. 1. However, as the first plurality of puzzle pieces 22 are utilized to color, they will decrease in size by the wearing off of the crayon material and eventually may become unsuitable or undesirable for completing the puzzle.

The present invention provides a second plurality of puzzle pieces, shown generally as 24, to replace the first plurality of puzzle pieces 22 whenever desired. Second plurality of puzzle pieces 24 include puzzle pieces 24*a* through 24*f* which correspond in shape respectively to first plurality of puzzle pieces 22*a* through 22*f*.

Second plurality of puzzle pieces 24 are preferably formed from a rigid cardboard material so that they may act as permanent replacement pieces for the original crayon puzzle pieces.

In a preferred embodiment, the depth of recessed portion 20 is about ⅛" whereas the thickness of the crayon puzzle pieces 22*a* through 22*f* is about ¼". Accordingly, as best depicted in FIG. 2, crayon puzzle pieces 22 extend above the upper surface 12*a* of puzzle frame 12. The extra thickness of crayon puzzle pieces 22 provide them with the rigidity necessary to act as crayons without substantial fear of breakage thereof during use in coloring.

On the other hand, second plurality of puzzle pieces 24 including pieces 24*a* through 24*f* are die-cut out of second portion 16 of frame 12 and have a height of about ⅛" which substantially corresponds to the height of recessed portion 20. When second plurality of puzzle pieces 24 are removed from second portion 16 of frame 12, they leave corresponding recessed portions 26*a* through 26*f* as best depicted in FIG. 3. In order to assist removal of second set of puzzle pieces 24 from second portion 16 of frame 12, a die-cut opening 28*a* through 28*f* is provided in each of second recessed portions 26*a* through 26*f* through which the finger of a child can be pushed to remove the second set of puzzle pieces from the frame.

It is also noted that a corresponding opening 30 may be provided in frame 12 behind first plurality of puzzle pieces 22 to assist in removing the pieces from the frame.

First portion 14 of frame 12 and second portion 16 of frame 12 may be joined together by a scored line of perforations 32 to permit pivoting of first portion 14 with respect to second portion 16 and separation of the two portions, if so desired. When separated, second portion 16 of frame 12 will form a tray for holding the puzzle pieces. It is noted that first plurality of puzzle pieces 22 will fit in and can be stored in the second recessed openings 26*a* through 26*f* in second portion 16 of frame 12.

It is noted that an appropriate drawing may be provided on the upper surface 12*a* of frame 12 in order to enhance the appearance and play value of the puzzle. Finally, in packaging the puzzle, a clear material 40 such as plastic can be shrink-wrapped around frame 12 to retain the puzzle pieces in the package.

As can be seen from the foregoing description, the present invention provides a puzzle which will provide hours of playing time for a child. The play value of such a puzzle is enhanced by providing two sets of puzzle pieces, especially where one of the sets of puzzle pieces are formed from a crayon material. Accordingly, while the present invention is inexpensive and easy to manufacture, it will achieve each of the objects and advantages noted above and will provide a neat and convenient learning tool for assisting children in developing appropriate cognitive skills.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A puzzle comprising a frame having a recessed portion formed therein, a first plurality of puzzle pieces formed from a crayon material and adapted to be selectively, removably arranged in a predetermined pattern in said recessed portion to complete said puzzle, and a second plurality of puzzle pieces adapted to be selectively, removably arranged in said predetermined pattern in said recessed portion after said first plurality of puzzle pieces are removed to complete said puzzle.

2. The puzzle as claimed in claim 1, wherein said first plurality of puzzle pieces are interchangeable with said second plurality of puzzle pieces.

3. The puzzle as claimed in claim 1, wherein said first plurality of puzzle pieces decrease in size as they are used as crayons to color.

4. The puzzle as claimed in claim 1, wherein said first plurality of puzzle pieces correspond in shape to said second plurality of puzzle pieces.

5. The puzzle as claimed in claim 1, wherein said second plurality of puzzle pieces are formed from a rigid paper material.

6. The puzzle as claimed in claim 1, wherein said frame includes a first region containing said recessed portion and a second region having a plurality of second recessed portions which releaseably hold the second plurality of puzzle pieces.

7. The puzzle as claimed in claim 6, wherein said second region of said frame is removeably coupled to said first region to form a tray for holding said second plurality of puzzle pieces.

8. The puzzle as claimed in claim 6, wherein each said first plurality of puzzle pieces fit respectively in at least one said plurality of second recessed portions when said first plurality of puzzle pieces are removed therefrom.

9. The puzzle as claimed in claim 6, further comprising a clear plastic wrapping removably covering said frame.

10. The puzzle as claimed in claim 1, wherein said frame is formed from a rigid paper material, said recessed portion having a depth which is smaller than the height of said first plurality of puzzle pieces.

11. The puzzle as claimed in claim 10 wherein said second plurality of puzzle pieces have a height essentially equal to the depth of said recessed portion.

* * * * *